US010602862B2

(12) United States Patent
Serpa

(10) Patent No.: US 10,602,862 B2
(45) Date of Patent: Mar. 31, 2020

(54) SECURE-GRIP DISPOSABLE DISH FOR FOOD

(71) Applicant: Michael Lawrence Serpa, Claremont, CA (US)

(72) Inventor: Michael Lawrence Serpa, Claremont, CA (US)

( * ) Notice: Subject to any disclaimer, the term of this patent is extended or adjusted under 35 U.S.C. 154(b) by 0 days.

(21) Appl. No.: 15/060,395

(22) Filed: Mar. 3, 2016

(65) Prior Publication Data

US 2017/0251844 A1 Sep. 7, 2017

(51) Int. Cl.
*A47G 19/02* (2006.01)

(52) U.S. Cl.
CPC ..... *A47G 19/02* (2013.01); *A47G 19/065* (2013.01)

(58) Field of Classification Search
CPC ..... A47G 19/02; A47G 19/022; A47G 19/00; A47G 23/0625; A47G 19/065
USPC ..... 220/574, 574.1, 574.2, 574.3, 575, 608, 220/669, 676
See application file for complete search history.

(56) References Cited

U.S. PATENT DOCUMENTS

| | | | | |
|---|---|---|---|---|
| D19,116 | S | 5/1889 | Locke | |
| 1,953,933 | A | 4/1934 | Gundelach | |
| 2,032,835 | A | 3/1936 | Collins | |
| D102,862 | S | 1/1937 | Sebring | |
| 2,295,860 | A | 9/1942 | Oliver | |
| 4,219,144 | A | 8/1980 | Hagelberg | |
| 4,966,297 | A * | 10/1990 | Doty | A47G 19/06 206/564 |
| 5,088,640 | A | 2/1992 | Littlejohn | |
| 5,152,398 | A | 10/1992 | Forestal et al. | |
| 5,236,119 | A | 8/1993 | Chu | |
| 5,947,011 | A | 9/1999 | Xu | |
| 6,021,914 | A * | 2/2000 | Schmidt | A47G 19/06 220/23.83 |
| 6,702,141 | B1 | 3/2004 | Cinque | |
| 6,715,630 | B2 | 4/2004 | Littlejohn et al. | |
| 7,037,471 | B1 | 5/2006 | Perlman | |
| 7,152,754 | B2 * | 12/2006 | Micciulla | A47G 19/03 220/574 |
| 7,337,943 | B2 | 3/2008 | Johns et al. | |

(Continued)

FOREIGN PATENT DOCUMENTS

| | | |
|---|---|---|
| JP | S62-24719 | 2/1987 |
| JP | 2005-67632 | 3/2005 |

OTHER PUBLICATIONS

PCT Search Report and Written Opinion dated May 29, 2017 for International Application No. PCT/US2017/020252, 16 pages.

*Primary Examiner* — Kareen K Thomas
(74) *Attorney, Agent, or Firm* — Knobbe, Martens, Olson & Bear LLP

(57) ABSTRACT

The embodiments provide a secure-grip disposable dish for food. A food surface and a raised rim together give the dish to some extent a concave shape. The dish includes a void for receiving a user's thumb. In a first embodiment the void for receiving a user's thumb is configured as a slot. In a second embodiment the void for receiving a user's thumb is configured as an aperture. An elevated shelf proximal to the void for receiving a user's thumb can be included to provide a spot for the tip of a user's thumb to rest on when the dish is in use. In an alternative embodiment, a void for receiving one or more fingers of a user is substituted for the void for receiving a user's thumb.

15 Claims, 6 Drawing Sheets

(56) References Cited

U.S. PATENT DOCUMENTS

| | | | | |
|---|---|---|---|---|
| 7,540,833 | B2 | 6/2009 | Johns et al. | |
| 7,588,163 | B1 | 9/2009 | Wilson | |
| D611,810 | S | 3/2010 | Hautzinger | |
| 7,854,339 | B2 | 12/2010 | Gartz et al. | |
| 7,878,355 | B2 | 2/2011 | Gartz et al. | |
| 7,878,356 | B2 | 2/2011 | Gartz et al. | |
| 8,292,118 | B2 * | 10/2012 | Ebesu | A47G 19/06 206/562 |
| 8,348,091 | B1 * | 1/2013 | Zox | A47G 19/06 206/564 |
| 8,439,215 | B2 | 5/2013 | Gartz et al. | |
| 8,584,929 | B2 | 11/2013 | Littlejohn et al. | |
| 8,651,366 | B2 | 2/2014 | Littlejohn et al. | |
| D702,504 | S | 4/2014 | Tibbets | |
| 8,684,260 | B2 | 4/2014 | White et al. | |
| D712,204 | S * | 9/2014 | Hatcher | D7/553.5 |
| 8,985,379 | B1 * | 3/2015 | Evans | A47J 45/00 206/562 |
| 2004/0099670 | A1 * | 5/2004 | Michaeli | A47G 19/06 220/574 |
| 2016/0106240 | A1 * | 4/2016 | Cai | A47G 19/065 220/574 |

* cited by examiner

Fig. 1a
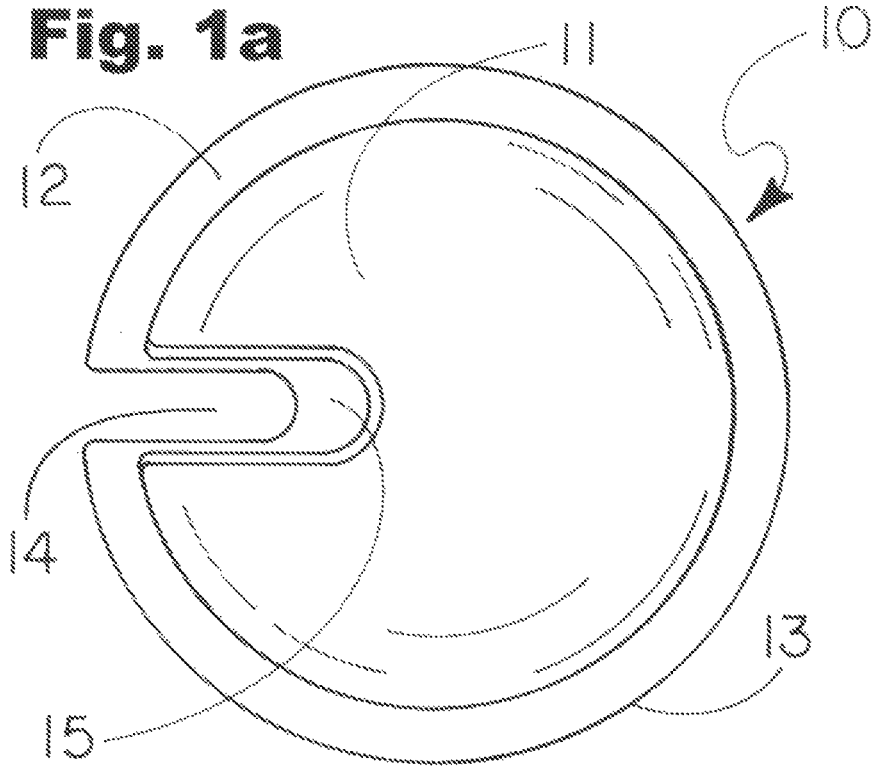
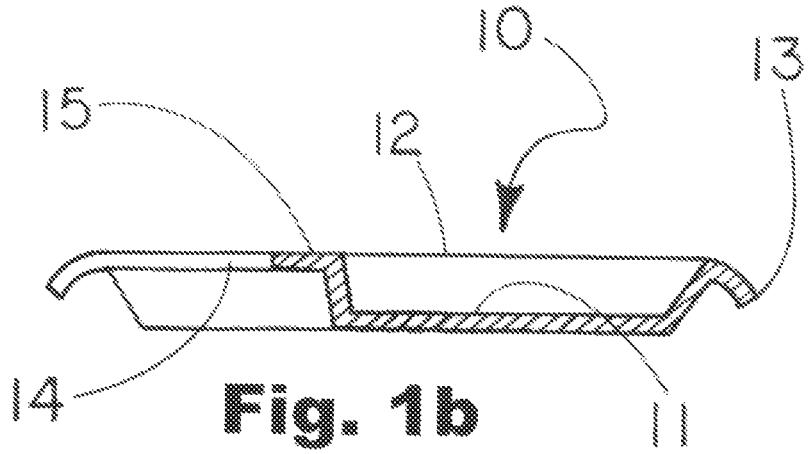
Fig. 1b

Fig. 3a
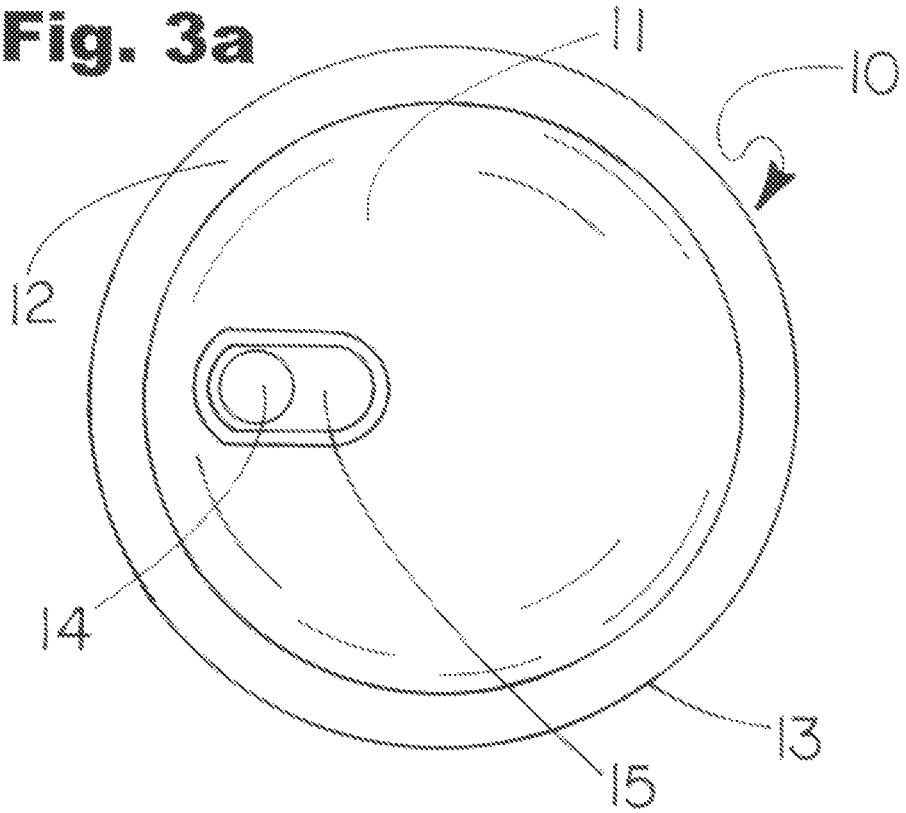
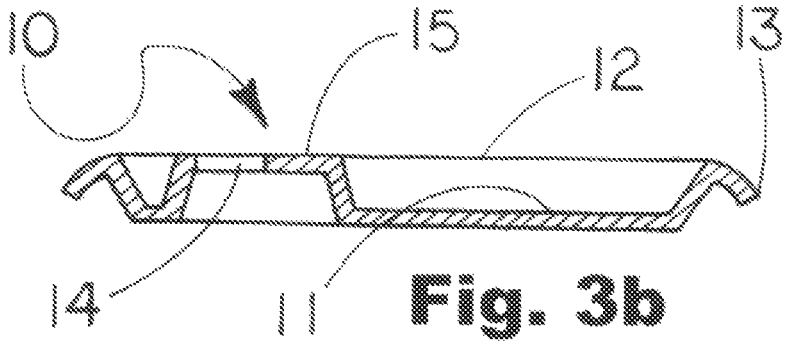
Fig. 3b

SECURE-GRIP DISPOSABLE DISH FOR FOOD

FIELD OF THE INVENTION

This invention relates to single-use plates and bowls that are vessels for food.

BACKGROUND

Disposable plates and bowls are ideal for many situations where food is served. They are appropriate for everything from small gatherings all the way to large-scale operations, and can be found at casual events as well as more formal affairs. These items offer both practicality and convenience on multiple levels. Low cost, light weight, compact storage, shatterproof design, and easy clean-up, are some of the factors contributing to widespread application of this type of single-use tableware.

Frequently called "paper plates" (or "paper bowls", which differ from plates primarily by having a deeper cavity), these articles are in fact made from a variety of materials in addition to paper. Regardless of the material of manufacture, though, functionality is paramount for disposable dishes.

[NOTE: Hereinafter the term "disposable dish" refers to a plate or bowl that is intended to be discarded after use as opposed to being washed and reused.]

Prior art disposable dishes typically consist of a food surface surrounded by a raised rim; they meet where the food surface flares outwards. The food surface is the area of the dish expected to accept food. When the dish is in a level food-holding orientation, the raised rim is higher than the food surface such that the disposable dish has to some extent a concave shape. This concave shape means there's a recess for holding any contents placed on the dish. Depending upon the type of food it's presumed to hold, the disposable dish may be quite shallow or otherwise.

The raised rim performs a number of functions. First, it acts to contain food on the food surface by forming part of the concave shape. The rim also adds overall rigidity to the disposable dish and supplies a means for the object to nest with other dishes making possible "stackable" storage. Finally, as a consequence of it being a raised section above the food surface, the rim provides a place for a user's thumb to rest when the user is grasping the disposable dish so that the user isn't forced to lay their thumb on the food surface and thereby potentially come into contact with food thereon.

Subject to its size and structure, a disposable dish can serve either as a food serving platter or as the dish from which food is actually eaten (using fingers or a utensil).

Though they tender much utility, disposable dishes aren't problem-free. Because they're meant to perform a temporary role, disposable dishes are usually thin and light and not as rigid as more "permanent" food serving platforms. This flimsy nature can present difficulty if the disposable dish is heavily laded with food and must be held or carried by a user-a frequent occurrence in circumstances where disposable dishes are used.

There are basically two techniques for holding a disposable dish on which there's food. One technique entails grasping the rim of the dish. The thumb of the hand doing the grasping rests on top of the dish's rim and the fingers of that hand curl around the bottom of the dish. A downside to this technique, however, is that it requires grip strength, which may be an issue for some people. Also, if the disposable dish isn't sturdy enough to handle the load it will droop or bend, thereby spilling food from the side of the dish away from the user's hand. To eliminate this possibility the user must employ both hands to control the dish by grasping the dish's rim at locations roughly opposite each other, in which case there isn't a hand available to move food from dish to mouth. Eating then can't commence without the availability of a stable platform of some sort to sustain the disposable dish, and eating is really the whole point of placing food on a dish in the first place.

Another technique for holding/carrying a disposable dish is to balance the dish on a user's open palm with the fingers and thumb of that hand spread apart to steady the dish. Even disposable dishes with a thin composition can be utilized in such a manner since the hand imparts a lot of support for the dish and the food on it. But this method leaves the dish and its contents vulnerable to being knocked off the person's hand. What's more, the disposable dish can slip off the user's hand if it isn't held level. Preventing these mishaps requires two hands, wherein the user secures the dish in place over the open hand by gripping the rim with the other hand. This, again, means there's no free hand to eat with.

An improved design yielding a disposable dish that can be held and carried securely with one hand would have value. The improved design should both enable adequate support for the dish when it contains food and prevent the dish from sliding off or being bumped from a user's hand. The various embodiments provide such a design.

SUMMARY

The various embodiments comprise a disposable dish having a void for receiving a user's thumb. In a first embodiment the void is configured as a slot extending from the outer edge of the dish's rim in a direction more or less towards the center of the dish's food surface. In a second embodiment the void is configured as an aperture (i.e., a hole) in the dish positioned between the outer edge of the rim and the center of the food surface. By inserting their thumb in the void the user essentially "locks" the disposable dish in place—with the palm and fingers of that same hand supplying support underneath. Due to the placement of the void, the palm and fingers will tend to be situated under the dish in a manner that optimizes support for the dish and its contents. The result is a secure-grip disposable dish for food that requires the use of just a single hand. Furthermore, only minimal grip strength from the hand is necessary to keep the dish in place. In an alternative embodiment, a void for receiving one or more fingers of a user is substituted for the void for receiving a user's thumb. These and other advantages of one or more aspects will be apparent from a consideration of the drawings and ensuing description.

DRAWING FIGURES

FIG. 1*a* shows a top plan view of a first embodiment.

FIG. 1*b* shows a side cutaway view of a first embodiment.

FIG. 2 shows a perspective view of a first embodiment in operation.

FIG. 3*a* shows a top plan view of a second embodiment.

FIG. 3*b* shows a side cutaway view of a second embodiment.

DETAILED DESCRIPTION AND OPERATION—FIRST EMBODIMENT

Figure 2:
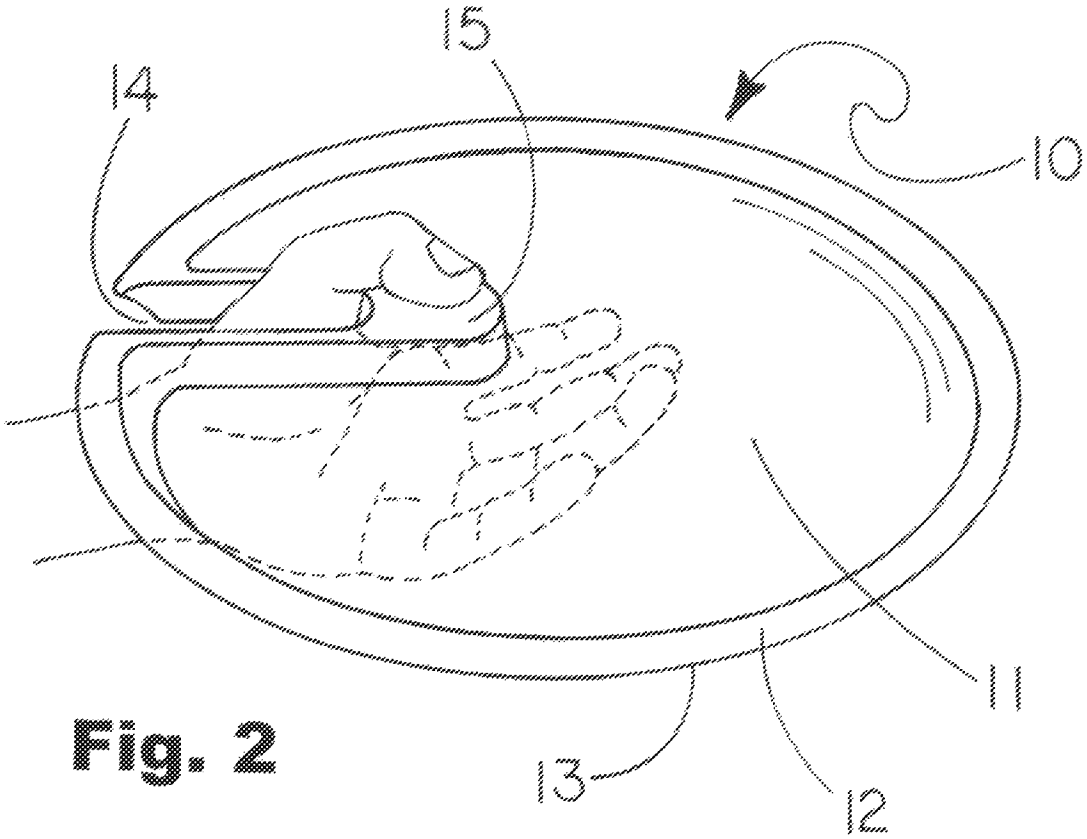

FIG. 1*a* shows a top view of a first embodiment. A disposable dish 10 has a food surface 11, which is that area of the disposable dish 10 intended to accept food. The disposable dish 10 also has a raised rim 12 surrounding at least a share of the food surface 11, the raised rim 12 and the food surface 11 together giving the disposable dish 10 to some extent a concave shape. This concave shape works to contain food when the disposable dish 10 is level in a food-holding orientation.

The raised rim 12 has an outer edge 13, which is that portion of the raised rim 12 furthest from the food surface 11. Additionally, the food surface 11 has a center point (not indicated), which is that point on the food surface 11 furthest from the outer edge 13 of the raised rim 12.

The disposable dish 10 includes a void 14. The void 14 is for receiving a user's thumb. In the case of the FIG. 1*a* first embodiment the void 14 is configured as a slot extending from the outer edge 13 of the raised rim 12 in a direction more or less towards the center point of the food surface 11. The void 14 is sized to accommodate the thumb of a user. When configured as a slot the length of the void 14 can vary, although preferably it extends far enough to fully receive a user's thumb.

If the raised rim 12 traces the outline of the void 14, this will establish a flange and help to prevent food from falling through the void 14 when the disposable dish 10 is being used.

The disposable dish 10 can include an elevated shelf 15 proximal to the void 14. The elevated shelf 15 would occupy a different level than the food surface 11. The purpose of the elevated shelf 15 is to provide a spot for the tip of a user's thumb to rest when the thumb is in the void 14 so that no part of the thumb touches the food surface 11 and, as a result, come into contact with food put there. To enhance its function the elevated shelf 15 can include a dimple (not shown) for the tip of a user's thumb to sit in to help the thumb secure the disposable dish 10.

In FIG. 1*b* is shown a side view of a disposable dish 10 in accordance with the first embodiment. The disposable dish 10 is in a level food-holding orientation. A concave shape is formed by the coordination of the food surface 11 and the raised rim 12. The void 14 extends from the outer edge 13 of the raised rim 12 in a direction more or less towards the center point of the food surface 11. Proximal to the void 14 is an elevated shelf 15 occupying a different level than the food surface 11. The elevated shelf 15 provides a spot on which the tip of a user's thumb can rest when the disposable dish 10 is in use.

FIG. 2 shows a disposable dish 10 of the first embodiment in operation. The thumb of a user's hand is in the void 14 with the tip of the thumb resting on the elevated shelf 15. The disposable dish 10 rests on the user's palm and fingers, which supply support underneath. If the disposable dish 10 is held or carried level in a food-holding orientation, the thumb will retain the disposable dish 10 in place over the user's hand with little or no grip strength required. And the palm and fingers bearing the load will be situated under the disposable dish 10 in a manner that tends to fully support the disposable dish 10 and its contents.

(Though a user's left hand is depicted in FIG. 2, the first embodiment is suitable for a right hand as well. The same is true of all other embodiments.)

DETAILED DESCRIPTION AND OPERATION—SECOND EMBODIMENT

In FIG. 3*a* is shown a top view of a second embodiment. A disposable dish 10 has a food surface 11, which is that area of the disposable dish 10 intended to accept food. The disposable dish 10 also has a raised rim 12 surrounding at least a share of the food surface 11, the raised rim 12 and the food surface 11 together giving the disposable dish 10 to some extent a concave shape. This concave shape works to contain food when the disposable dish 10 is level in a food-holding orientation.

The raised rim 12 has an outer edge 13, which is that portion of the raised rim 12 furthest from the food surface 11. Additionally, the food surface 11 has a center point (not indicated), which is that point on the food surface 11 furthest from the outer edge 13 of the raised rim 12.

The disposable dish 10 includes a void 14 for receiving a user's thumb. In the case of the FIG. 3*a* second embodiment the void 14 is configured as an aperture. The void 14 is positioned between the outer edge 13 of the raised rim 12 and the center point of the food surface 11. The void 14 is sized to accommodate the thumb of a user.

The disposable dish 10 can include an elevated shelf 15 proximal to the void 14. If included, the elevated shelf 15 would occupy a different level than the food surface 11. The purpose of the elevated shelf 15 is to provide a spot for the tip of a user's thumb to rest when the thumb is in the void 14 so that no part of the thumb touches the food surface 11 and, as a result, come into contact with food placed there. To enhance its function the elevated shelf 15 can include a dimple (not shown) for the tip of a user's thumb to sit in to help the thumb lock the disposable dish 10 in place.

If the elevated shelf 15 is included, it is possible to construct the disposable dish 10 such that the void 14 resides at a level more like that of the elevated shelf 15 than that of the food surface 11. This would reduce the likelihood of food falling through void 14 when the disposable dish 10 is being used.

FIG. 3*b* shows a side view of a disposable dish 10 in accordance with the second embodiment. The disposable dish 10 is in a level food-holding orientation. A concave shape is formed by the coordination of the food surface 11 and the raised rim 12. The void 14 is positioned between the outer edge 13 of the raised rim 12 and the center point of the food surface 11. Proximal to the void 14 is an elevated shelf 15 occupying a different level than the food surface 11. The elevated shelf 15 provides a spot on which the tip of a user's thumb can rest when the disposable dish 10 is in use.

Figure 4:
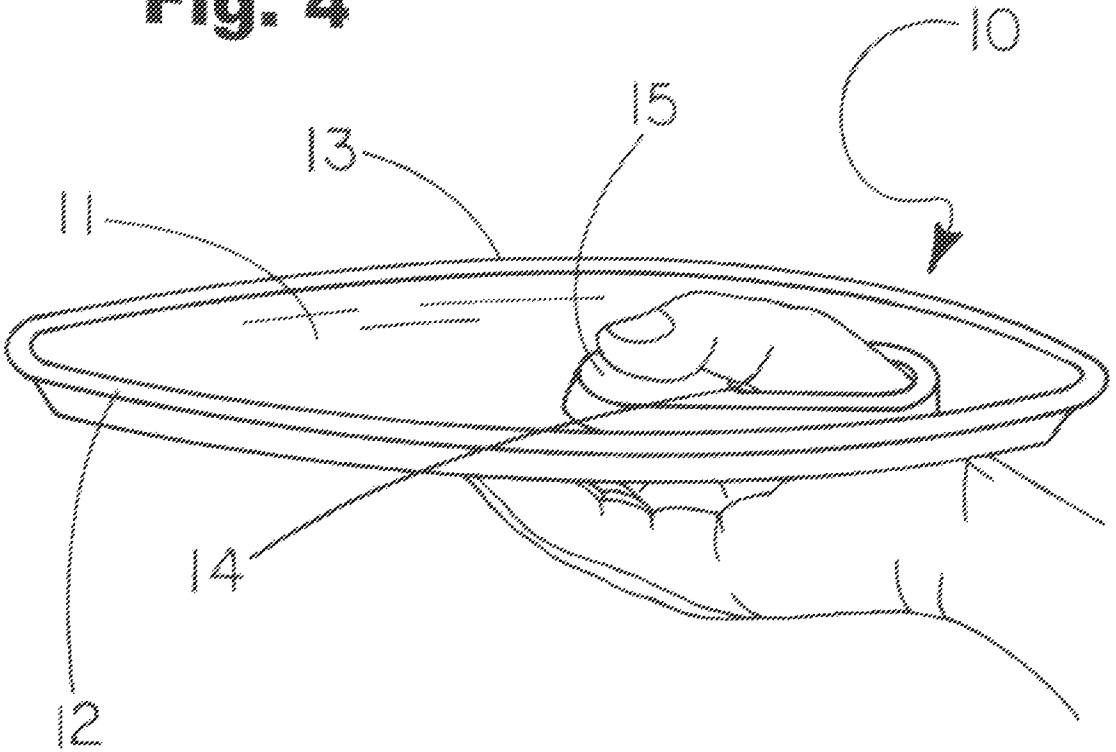
FIG. 4 shows a perspective view of a second embodiment in operation.

FIG. 4 shows a disposable dish 10 of the second embodiment in operation. The thumb of a user's hand is in the void 14 with the tip of the thumb resting on the elevated shelf 15. The palm and fingers of the hand supply support underneath. If the disposable dish 10 is held or carried level in a food-holding orientation, the disposable dish 10 will be retained in place over the user's hand with little or no grip strength required. And the disposable dish 10 will be for the most part situated over the hand underneath in a manner tending to optimize support for the disposable dish 10 when it's loaded with food.

(Though a user's right hand is depicted in FIG. 4, the second embodiment is also suitable for a left hand. The same is true of all other embodiments.)

In a variation (not illustrated) on this second embodiment, the aperture can instead be positioned at or near the center point of the food surface 11, but this arrangement would be less effective in use since the disposable dish 10 wouldn't be centered over the user's palm and fingers.

DETAILED DESCRIPTION AND OPERATION—ALTERNATIVE EMBODIMENT

Figure 5:
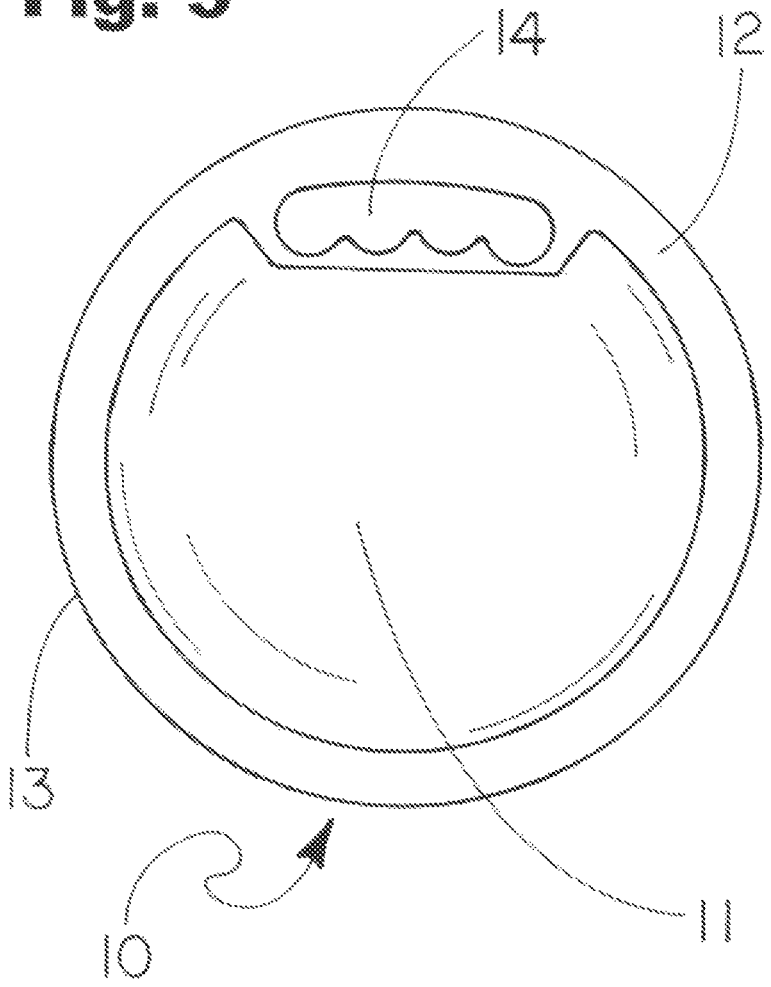
FIG. 5 shows a top plan view of an alternative embodiment.

A top view of an alternative embodiment can be seen in FIG. 5. A disposable dish 10 has a food surface 11, which is that area of the disposable dish 10 intended to accept food. The disposable dish 10 also has a raised rim 12 surrounding at least a share of the food surface 11, the raised rim 12 and the food surface 11 together giving the disposable dish 10 to some extent a concave shape. This concave shape works to contain food when the disposable dish 10 is level in a food-holding orientation.

The raised rim 12 has an outer edge 13, which is that portion of the raised rim 12 furthest from the food surface 11. Additionally, the food surface 11 has a center point (not indicated), which is that point on the food surface 11 furthest from the outer edge 13 of the raised rim 12.

The disposable dish 10 includes a void 14 configured as an aperture. The void 14 is for receiving one or more fingers of a user and is sized and shaped to do so. Ideally, the void 14 is positioned somewhere between the outer edge 13 of the raised rim 12 and the center point of the food surface 11. The void 14 can even be integrated with the raised rim 12.

Figure 6:
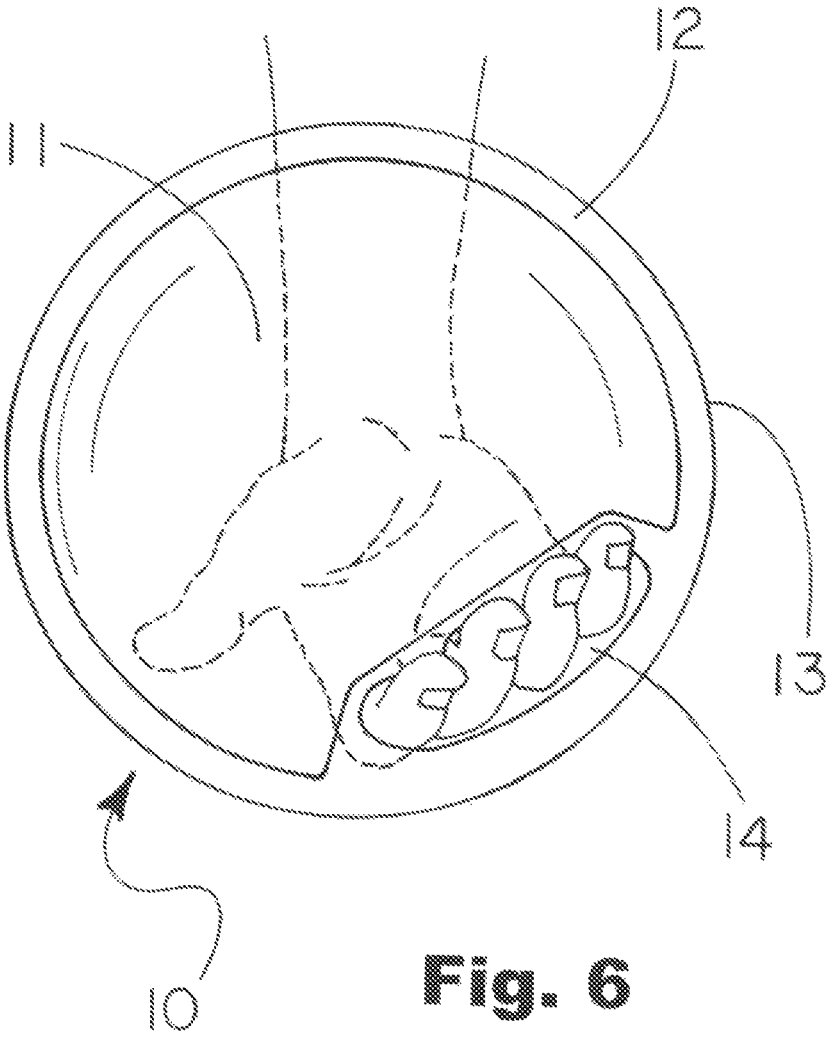
FIG. 6 shows a perspective view of an alternative embodiment in operation.

FIG. 6 shows the alternative embodiment in operation. The disposable dish 10 rests on a user's palm and the fingers of that hand are in the void 14. The disposable dish 10 is for the most part centered over the palm. This enables the user to support and secure the disposable dish 10 with just one hand.

This alternative embodiment could prove to be less desirable than other embodiments in that the void 14, being able to receive one or more fingers of a user, takes up more usable space on the disposable dish 10 than is required for other embodiments (meaning there's less room for food). Nevertheless, this alternative embodiment does present distinct advantages of merit over the prior art.

CONCLUSION, RAMIFICATIONS, AND SCOPE

Accordingly, it can be seen that the disposable dish of the various embodiments can be held and carried securely with just one hand. The various embodiments are compatible with functional and aesthetic alterations, such as disposable plates or bowls incorporating dividers for separating food items or having decorative graphics/shapes. Moreover, the various embodiments are suitable for different materials and coatings used in the manufacture of single-use tableware. Inasmuch as the various embodiments provide a secure-grip solution, they might even facilitate the design and fabrication of more elaborate disposable plate and bowl creations that aren't feasible with prior art single-use tableware.

Although the description above contains many specificities, these should not be construed as limiting the scope of the embodiments but as merely providing instances of some of several embodiments. Thus, the scope of the embodiments should be determined by the appended claims and their legal equivalents rather than by the examples given.

I claim:

1. A food dish comprising:

a food surface;

a raised rim extending above and at least partially surrounding the food surface;

a void for receiving a finger or thumb of a hand of a user; and an elevated shelf above the food surface between at least a portion of the food surface and the void, the elevated shelf positioned adjacent the void and dimensioned to support the finger or thumb when the finger or thumb is received in the void during use of the food dish, wherein a boundary of the void is delimited at least in part by the elevated shelf, wherein the food surface has an interior region and the raised rim has an outermost edge, and wherein the void comprises a slot extending inwardly from the outermost edge of the raised rim towards and into the interior region of the food surface such that the slot defines a gap in the outermost edge of the raised rim and a gap in the food surface.

2. The food dish of claim 1, wherein the elevated shelf comprises an uneven surface.

3. The food dish of claim 2, wherein the uneven surface comprises a dimple sized and shaped to support a tip of the thumb.

4. The food dish of claim 1, wherein the raised rim traces a boundary of the slot.

5. The food dish of claim 1, wherein the elevated shelf comprises a sheet that defines a lateral support surface to support the finger or thumb and a thickness transverse to the lateral support surface, the lateral support surface having a radially oriented width that is greater than the thickness.

6. A food dish comprising:

a food surface;

a raised rim extending above and at least partially surrounding the food surface;

a void for receiving a finger or thumb of a hand of a user; and an elevated shelf above the food surface, the elevated shelf disposed inwardly of the raised rim and between at least a portion of the food surface and the void, the elevated shelf comprising a sheet that defines a lateral support surface to support the finger or thumb and a thickness transverse to the lateral support surface, the lateral support surface having a radially oriented width that is greater than the thickness, wherein the food surface has an interior region and the raised rim has an outer edge, wherein the void comprises an aperture positioned between the outer edge of the raised rim and the interior region of the food surface, and wherein the food surface completely and continuously surrounds the aperture.

7. The food dish of claim 6, wherein the elevated shelf comprises an uneven surface.

8. The food dish of claim 6, wherein a boundary of the void is delimited at least in part by the elevated shelf.

9. The food dish of claim 6, wherein the food surface surrounds the aperture without any intervening dividers.

10. A food dish comprising:

a food surface;

a raised rim extending above and at least partially surrounding the food surface, the raised rim defining an outermost boundary of the food dish; and a void for receiving a finger or thumb of a hand of a user, wherein an upper boundary of the void farthest from the outermost boundary defines an elevated ridge above the food surface adjacent the void, the elevated ridge positioned and shaped to support a portion of the finger or thumb above the food surface when the finger or thumb is inserted into the void, wherein the food surface has an interior region and the raised rim has an outermost edge, and wherein the void comprises a slot extending from the outermost edge of the raised rim towards and into the interior region of the food surface such that the slot defines a gap in the outermost edge of the raised rim and a gap in the food surface.

11. The food dish of claim 10, wherein the elevated ridge is directly adjacent the void.

12. The food dish of claim 10, wherein the food dish comprises a concave shape.

13. The food dish of claim 10, wherein the raised rim traces a boundary of the slot.

14. The food dish of claim 10, wherein the elevated ridge comprises an uneven surface.

15. A food dish comprising:

a food surface;

a raised rim extending above and at least partially surrounding the food surface, the raised rim defining an outermost boundary of the food dish; and a void for receiving a finger or thumb of a hand of a user, wherein an upper boundary of the void farthest from the outermost boundary defines an elevated ridge above the food surface adjacent the void, the elevated ridge positioned and shaped to support a portion of the finger or thumb above the food surface when the finger or thumb is inserted into the void, wherein the food surface has an interior region and the raised rim has an outermost edge, wherein the void comprises a slot extending from the outermost edge of the raised rim towards the interior region of the food surface such that the slot defines a gap in the outermost edge of the raised rim, wherein the elevated ridge comprises an uneven surface and a dimple sized and shaped to support a tip of the thumb.

* * * * *